US005969608A

United States Patent [19]

Sojdehei et al.

[11] Patent Number: 5,969,608

[45] Date of Patent: Oct. 19, 1999

[54] MAGNETO-INDUCTIVE SEISMIC FENCE

[75] Inventors: John Sojdehei, Panama City Beach; Felipe Garcia, Panama City; Robert Woodall, Lynn Haven, all of Fla.

[73] Assignee: The United States of America as represented by the Secretary of the Navy, Washington, D.C.

[21] Appl. No.: 09/030,517

[22] Filed: Feb. 23, 1998

[51] Int. Cl.[6] ..... G08B 13/27

[52] U.S. Cl. ..... 340/551; 340/541; 340/539

[58] Field of Search ..... 340/541, 551, 340/539, 689, 690, 665, 531, 854.8, 854.6; 455/40, 41; 73/DIG. 1

[56] References Cited

U.S. PATENT DOCUMENTS

| | | | |
|---|---|---|---|
| 3,573,817 | 4/1971 | Akers | 340/539 |
| 3,984,803 | 10/1976 | Hawk et al. | 340/539 |
| 4,374,378 | 2/1983 | Lee | 340/566 |
| 4,630,035 | 12/1986 | Stahl et al. | 340/539 |
| 4,857,912 | 8/1989 | Everett et al. | 340/541 |
| 5,200,735 | 4/1993 | Hines | 340/539 |
| 5,319,698 | 6/1994 | Glidewell et al. | 340/541 |
| 5,483,224 | 1/1996 | Rankin et al. | 340/531 |

*Primary Examiner*—Jeffery A. Hofsass
*Assistant Examiner*—Anh La
*Attorney, Agent, or Firm*—Harvey A. Gilbert; Donald G. Peck

[57] ABSTRACT

An intrusion detector has buried sensor modules arranged along a perimeter to sense seismic vibrations caused by intrusions within the area defined by the perimeter. The sensor modules transmit data representative of the intrusions via magneto-inductive signals in the ELF to VLF range through ground, air, and/or water to at least one buried relay module within the area. The relay modules transmit RF signals representative of the intrusion data via a camouflaged RF antenna to mobil or fixed stations for appropriate action. Transmission of magneto-inductive signals in the ELF to VLF range is clandestine and reliable, and locations of buried sensor modules and relay modules are not revealed to intruders to reduce the possibility of evasion or tampering. The sensor modules may have sensor elements sensitive to humans, vehicles, and low flying aircraft to give enforcement officers the opportunity to better utilize their resources where the intrusions are occurring. In addition, this system could be placed along many well-used passageways, such as highways, roads, trails, air corridors, etc. to gather information regarding use of facilities and resources to help governmental officials and planners make intelligent decisions.

15 Claims, 3 Drawing Sheets

MAGNETO-INDUCTIVE SEISMIC FENCE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to sensors of encroachment in an area. In particular, this invention relates to buried seismic sensors on land or underwater and relays arranged to detect encroachments into an area and to indicate the intrusions at remote stations.

Current methods used to stop illegal border crossings rely on the intensive use of man power. This intensive use typically takes the form of extensive patrolling of particular areas via helicopters or land vehicles. Illegal crossings are detected primarily by visual means. Clearly, this approach is unsatisfactory since the vast areas of borders that need to be patrolled and the limited number of personnel on patrol means that relatively few arrests will be made among the thousands of illegal crossings that go unchecked each year. This manpower intensive approach creates the impossible requirement that the officers on patrol need to be at numerous places at any given moment in order to detect and then apprehend the intruders. Other methods for detection use conspicuous sensors and RF broadcast towers that are so visible to violators, that they simply avoid them and cross the border where no sensors or transmitters exist. Furthermore, intruders have been known to disable transmitters and sensing stations that are visible.

Thus, in accordance with this inventive concept, a need has been recognized in the state of the art for undetectable, buried seismic sensors on land or underwater using magneto-inductive signals in the ELF to VLF range to communicate intrusions to remote stations.

SUMMARY OF THE INVENTION

The present invention is directed to providing a seismic detector system that may be used to sense encroachments in an area. A sensor module senses seismic vibrations, generates signals representative of the seismic vibrations and transmits the representative signals via magneto-inductive signals in the ELF to VLF range. A distant relay module receives the magneto-inductive signals, demodulates the representative signals from them, and broadcasts RF signals representative of the demodulated signals to a remote station.

An object of the invention is to provide at least one seismic sensor that indicates the presence of an intruder and transmits representative signals via magneto-inductive signals in the ELF to VLF range.

Another object of the invention is to provide a plurality of seismic sensors having overlapping seismic sensing ranges located along a perimeter for transmitting magneto-inductive signals in the ELF to VLF range that indicate encroachment in an area.

Another object of the invention is to provide for encroachment detection and reporting that covers large areas and distinguishes different types of intruders, such as humans, automobiles, aircraft, etc.

Another object of the invention is to provide a plurality of buried seismic sensors transmitting magneto-inductive signals in the ELF to VLF range that indicate encroachment of humans, automobiles, aircraft, etc.

Another object of the invention is to provide for encroachment detection and reporting that is unlikely to be detected by intruders.

Another object of the invention is to provide seismic sensors located along an extensive perimeter to sense intrusions and send representative magneto-inductive signals in the ELF to VLF range to multiply the effectiveness of enforcement officers.

Another object of the invention is to provide a unique identification number assigned to each and every seismic sensor module to indicate the location of the encroachment.

Another object of the invention is to provide for detection and reporting of encroachments to coordinate different law enforcement agencies.

Another object of the invention is to provide a plurality of buried seismic sensors of intrusions that are located along a remote perimeter and are not easily vandalized.

These and other objects of the invention will become more readily apparent from the ensuing specification when taken in conjunction with the appended claims.

DESCRIPTION OF THE PREFERRED EMBODIMENT

Figure 1:
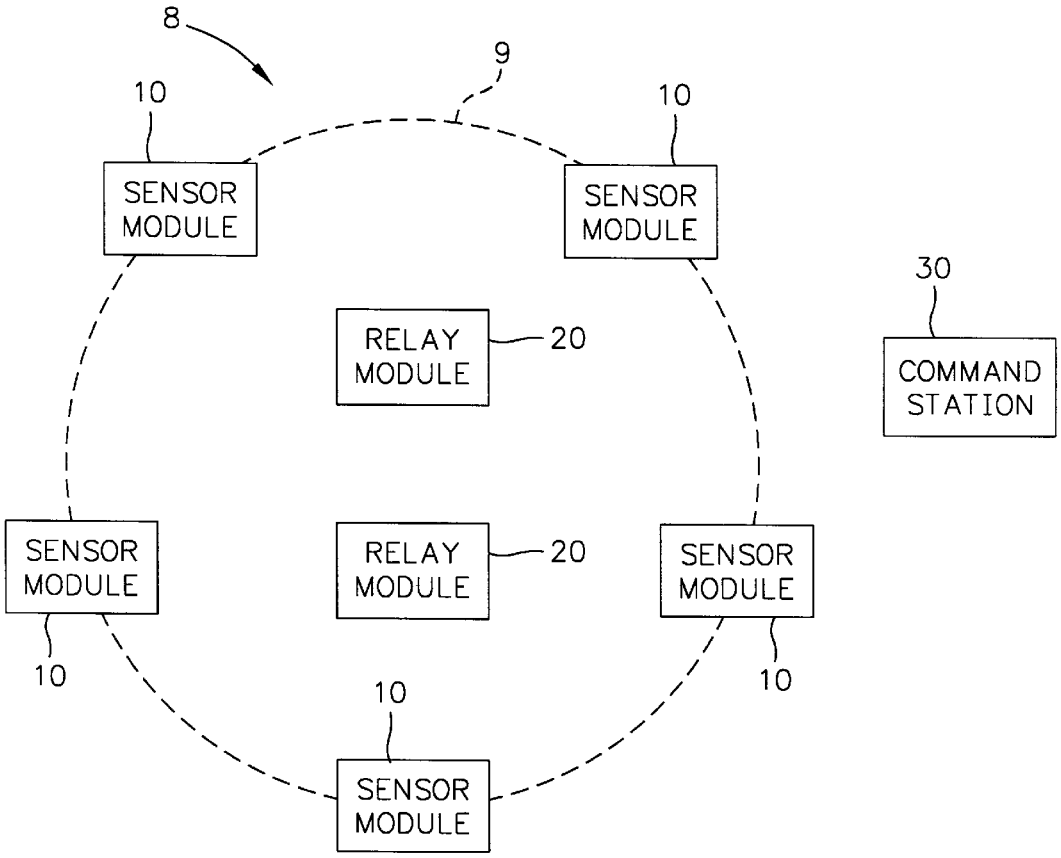
FIG. 1 represents a plurality of sensing modules located along a remote perimeter for sensing encroachments and a relay module transmitting signals representative of intrusions to a control station.

Referring to FIG. 1 of the drawings, a virtually undetectable seismic fence 8 has sensor modules 10 buried in the ground along a remote border or perimeter 9 of an area. Each sensor module 10 is responsive to the seismic disturbances or vibrations caused by nearby encroachments to produce signals that are representative of the intrusion. These vibrations may be caused by walking, running, or swimming humans, motor vehicles and low flying aircraft, for example.

Sensor modules 10 usually are located close enough to one another so that their seismic sensing ranges overlap. This creates an unbroken seismic barrier for intrusion detection. When an encroachment is detected, representative magneto-inductive signals in the extremely low frequency (ELF) to very low frequency (VLF) range are sent from sensing module 10 that sensed the intrusion to relay module 20. Propagation of the encroachment information via magneto-inductive signals in the ELF to VLF range is virtually undetectable by the intruders and is reliable, even in high acoustic, magnetic, electric, or electromagnetic noise backgrounds. Relay module 20 then broadcasts this information via radio frequency (RF) signals to a central command station 30 for coordination of resources, or the RF signals may be sent directly to mobile units for appropriate action.

In addition, the use of magneto-inductive ELF to VLF communication frequencies in the 1–4000 Hz range not only allows the transmission of intrusion information clandestinely through ground, water, and air, but also permits such transmissions to one or more remote RF relay modules 20 that are located well inside the border or perimeter defined by sensor modules 10. If RF antenna 27*a* of one of RF relay modules 20 were to be discovered and the interconnected module 20 were disabled by the intruders, the other relay modules 20 could function as backup units to relay the intrusion information to station 30.

Figure 2:
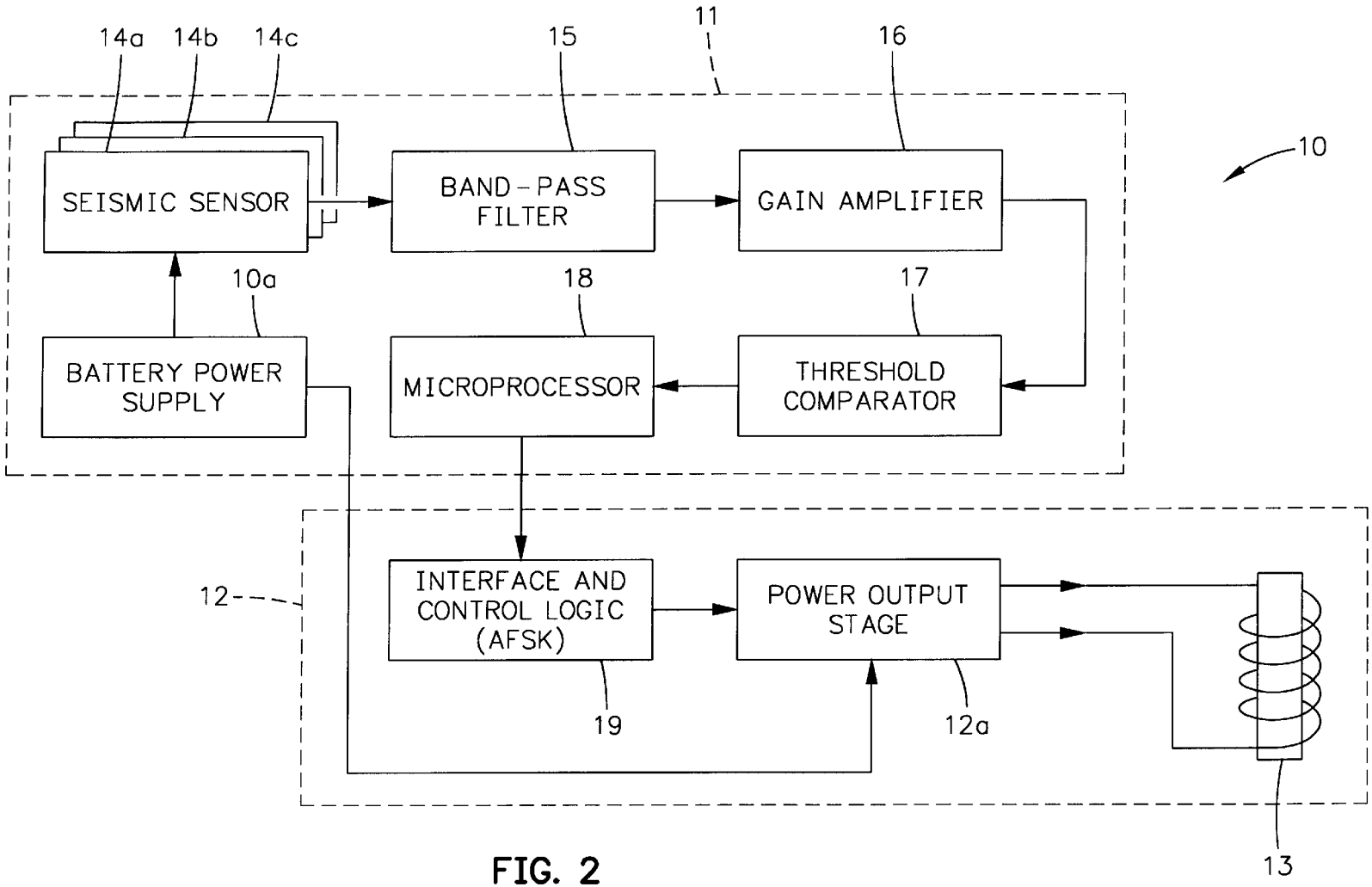
FIG. 2 schematically shows details of a sensing module.

In FIG. 2 each sensor module 10 has a sensor section 11 that includes one or more seismic sensors and associated logic to detect intruders. Each sensor module 10 has a magneto-inductive signal transmitter section 12 having an antenna 13 to transmit the sensed data via magneto-inductive signals in the ELF to VLF range. Both of these sections may be buried in the ground or underwater.

Figure 3:
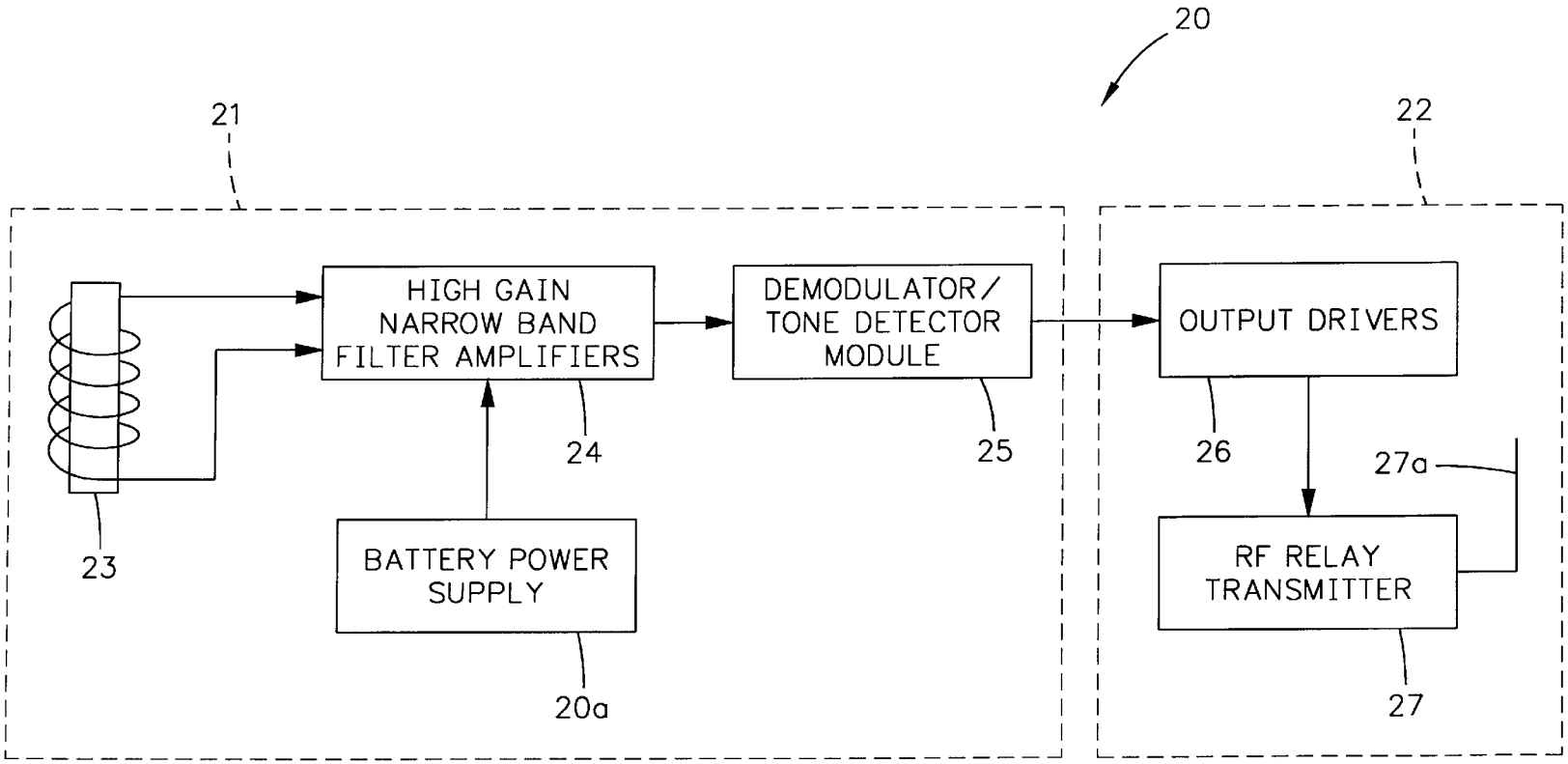
FIG. 3 schematically shows details of the relay module.

Referring to FIG. 3, each relay module 20 has a magneto-inductive signal receiver section 21 having an antenna 23 to receive the sensed data that is transmitted from sensor module 10 via the magneto-inductive signals in the ELF to VLF range. Section 21 may be buried in the ground or underwater. Relay module 20 also has an RF relay section 22 that may be buried except for RF antenna 27*a* which may extend above the ground to transmit or broadcast RF signals that contain the sensed information to station 30.

Magneto-inductive communication with magneto-inductive signals uses the quasi-static AC magnetic field generated by transmitting antenna 13 in each sensor module 10 that is operated with a very low radiation impedance. The transmitting antenna is either air-cored or may employ steel or ferrite for field enhancement. Receiver antenna 23 in each relay module 20 may have a similar construction as each transmitter antenna 13.

Referring to FIG. 2, sensor module 10 includes sensor section 11 having a battery power supply 10*a* appropriately coupled to power the components of sensor section 11 and magneto-inductive signal transmitter section 12. All of these obvious connections are not shown to avoid unnecessary cluttering. Sensor section 11 has one or more seismic sensors or other kinds of sensors, such as magnetic, acoustic, or infrared, 14*a*, 14*b*, and 14*c*, for example, which are used for detection of different types of intruders, such as human, vehicles, and low-flying aircraft.

Seismic sensors 14*a*, 14*b*, and 14*c* may be any of many widely available units that, typically, may have piezoelectric sensory elements that provide representative output signals when they are subjected to acoustic or seismic vibrations. The sensory elements provided in the different sensors 14*a*, 14*b*, and 14*c* are likely to be differently designed to give multiple sensory capabilities for the different types of intruders.

Seismic sensors 14*a*, 14*b*, and 14*c* of sensor section 11 are coupled to at least one band pass filter 15 which is used to eliminate background and undesirable noise from the frequency band of interest. A programmable variable gain amplifier 16 is coupled to filter 15 and is used to increase or decrease the range of detection. Threshold comparator 17 receives the output from amplifier 16 and compares the amplitude and duration of the signals sensed by seismic sensors 14*a*, 14*b*, and 14*c* with preprogramed amplitudes and durations. An interconnected microprocessor 18 receives output signals from threshold comparator 17, appropriately processes the results of the comparison performed by threshold comparator 17, and generates signals that identify the intruder. These identifying signals provide information regarding the type of intruder, number of intruders, what type of vehicle, and the location of the intrusion.

The identifying signals are coupled to interface and control logic 19 of transmitter section 11 of sensor module 10. Interface and control logic 19 encodes the identifying signals to a series of tones and modulates a carrier frequency of approximately 3000 Hz, in this embodiment, with these tones by using the audio frequency shift keying (AFSK) modulation technique. Other carrier frequencies in the ELF to VLF range of 1 to 4000 Hz might be used.

Battery pack power supply 10*a* supplies the power to drive power output stage 12*a* of transmitter section 12 so that it transmits the intrusion data or identifying signals via magneto-inductive signals in the ELF to VLF range. MOSFET drivers in power output stage 12*a* generate the magneto-inductive signals in the ELF to VLF range which are coupled to antenna 13. Consequently, in this manner antenna 13 transmits the intrusion data from each sensor module 10 in fence 8 to one or more relay modules 20 which are usually located within the perimeter defined by fence 8.

Referring once again to FIG. 3, each relay module 20 has a magneto-inductive signal receiver section 21 connected to magneto-inductive signal antenna 23 and RF relay section 22. Receiver section 21 has a battery power supply 20*a* appropriately coupled to power the components of relay module 20, although all these connections are not shown to avoid cluttering the drawings. Magneto-inductive signal antenna 23 receives the magneto-inductive signals in the ELF to VLF range from sensor modules 10 and couples them to high gain narrow band filter amplifiers 24 of receiver section 21. High gain narrow band filter amplifiers 24 may be a series of two high gain narrow band filter amplifiers coupled in a single superheterodyne configuration. This configuration reduces the internal noise of the circuit and maintains a very high gain. The output from amplifiers 24 is connected to demodulator/tone detector module 25. Demodulator/tone detector module 25 has an amplitude modulation (AM) demodulator that detects the smallest amplitude modulation of received carrier frequency and narrow band phase locked loop (PLL) based tone decoders that determine the constituents of the tones. The PLL converts the tone bursts into the corresponding voltage levels necessary to reconstruct the transmitted tones. The output of the PLL of receiver section 21 is coupled to output drivers 26 which drive RF relay transmitter 27. RF relay transmitter 27 is connected to RF antenna 27*a* that extends above the ground to relay the intrusion information from relay module 20 to central data gathering station 30 or other interested receivers such as patrol unit(s), border patrol station(s), border patrol helicopters, aircraft, or via satellite to any station or location in the world. This capability gives law enforcement agencies the opportunity to perform their jobs more effectively.

In accordance with this invention, encroachments will be detected by a number of buried seismic sensor modules 10 and buried relay modules 20 that have only their camouflaged RF antennas 27*a* above ground. The relay modules 20 are located a safe distance behind sensor modules 10 located along a perimeter or border. Optionally, modules 10 and 20 can be connected to electrical power lines or have power sources that may be rechargeable with photo voltaic solar cells or other means. As mentioned before, most of the components are buried so that their presence will be undetectable. This assures long service.

Upon encroachment, the seismic sensors 14 in sensor module 10 detect vibrations created by the encroachment of moving objects. The logic circuitry in sensor module 10 establishes what type of object is creating the seismic pattern and stores it in a register. If the vibrations are from human footsteps, from automobile or aircraft, encroachment data will be transmitted through the ground via magneto-inductive signals in the ELF to VLF range from buried magneto-inductive transmitter sections 12 of sensor modules 10 to buried receiver sections 21 of relay modules 20 that may be located miles away. The encroachment data will be broadcast via RF transmission from RF antennas 27*a* of RF relay sections 22 to manned remote RF receivers at station 30 or patrol units. Each sensor module 10 and relay module 20 will have a unique code which is transmitted to indicate the area where intrusion has occurred. Sensor modules 10 and relay modules 20 will be spaced in such a fashion to yield integrated coverage along a perimeter.

Since sensor modules 10 can be used to cover a large area and distinguish different types of intruders, patrols will know when, where, and how to respond. If the encroachment of low flying aircraft is detected and no known flight plan is on record, then officers will have advanced warning and may have probable cause to engage such aircraft as part of drug interdiction efforts. This system may be used wherever seismic surveillance is needed, such as inside buildings, private residences, private businesses, at military check points, along freeways, etc. This system will act as a highly effective force multiplier, allowing officers to remain stationed at high crossover points while still being able to detect and respond to encroachments in more remote areas. Assets used by border patrols and other enforcement agencies may be more effectively allocated with this system in operation. Particularly in these types of applications, the buried sensor modules 10 and relay modules 20 are very likely to provide long reliable service since they are hard to locate and, consequently, cannot be vandalized or otherwise disabled.

The disclosed components and their arrangements as disclosed herein all contribute to the novel features of this invention. These novel features assure more reliable and effective use of sensor modules 10 and relay modules 20 to successfully conduct surveillance and monitoring along many differently shaped perimeters. For example, the perimeter of acoustic surveillance could be established around a large area containing, for example, a vital industrial complex, or it could extend for miles along a border separating countries. The components of the modules might necessarily have to be tailored for these different tasks, yet such modifications will be within the scope of this inventive concept. For example, different sensor elements could be selected, different combinations of frequencies in the ELF to VLF range could be selected, and different modulation techniques could be selected to better accommodate different mission requirements without departing from the scope of this invention. Furthermore, having this disclosure in mind, one skilled in the art to which this invention pertains will select and assemble suitable components for the modules from among a wide variety available in the art and appropriately interconnect them to satisfactorily function as the disclosed constituents of sensor module 10 and relay module section 20. Therefore, the disclosed arrangement is not to be construed as limiting, but rather, is intended to demonstrate this inventive concept.

In accordance with this invention sensor modules 10 and relay modules 20 need not only be used to detect intrusions, but could be placed to gather data along many well-used passageways, such as highways, roads, trails, air corridors, etc. The buried components will not be tampered with and the data will be reliably conveyed by magneto-inductive signals in the VLF to ELF range. Thus, gathered information would be reliable and accurate and would be valuable regarding utilization of facilities and resources. This will help governmental officials, planners, and others who need such information for intelligent decision making.

It should be readily understood that many modifications and variations of the present invention are possible within the purview of the claimed invention. It is to be understood that within the scope of the appended claims the invention may be practiced otherwise than as specifically described.

We claim:

1. A seismic detector system comprising:

at least one sensor module fully buried in one of a ground environment and a water environment to sense seismic vibrations, to generate signals representative of said seismic vibrations and to transmit said representative signals through said one of a ground environment and a water environment via magneto-inductive signals in the ELF to VLF range not to exceed approximately 4000 Hz; and at least one relay module to receive said magneto-inductive signals in said one of a ground environment and a water environment, to demodulate said representative signals from said magneto-inductive signals, and to broadcast through the air RF signals representative of said demodulated signals.

2. A seismic detector system according to claim 1 further comprising:

at least one station to receive said RF signals.

3. A seismic detector system according to claim 1 wherein said at least one sensor module comprises:

a plurality of sensor modules fully buried in said one of a ground environment and a water environment and arranged to define a perimeter, each of said plurality of sensor modules having overlapping sensitivities with adjacent ones of said plurality of sensor modules along said perimeter.

4. A seismic detector system according to claim 1 wherein each said sensor module includes a sensor section to sense said seismic vibrations and generate said representative signals and a transmitter section coupled to said sensor section to convey said representative signals through said one of a around environment and a water environment via magneto-inductive signals in the ELF to VLF range, and each said relay module includes a receiver section fully buried in said one of a ground environment and a water environment for receiving said magneto-inductive signals and demodulating said representative signals therefrom to form demodulated signals and an RF relay transmitter and RF antenna coupled to said receiver section to broadcast RF signals representative of said demodulated signals.

5. A seismic detector system according to claim 4, wherein each said sensor section has a plurality of seismic sensor elements to detect different sources of said seismic vibrations.

6. A seismic detector system according to claim 1 wherein each said sensor module includes at least one of the group of sensors for sensing magnetic influences, acoustic waves, infrared emissions, and heat fluctuations.

7. A method for detecting seismic vibrations in a ground environment or a water environment, comprising the steps of:

fully burying at least one sensor module in one of a ground environment and a water environment;

sensing seismic vibrations in said one of a ground environment and a water environment using said at least one sensor module;

generating signals representative of said seismic vibrations using said at least one sensor module;

transmitting said representative signals from said at least one sensor module through said one of a ground environment and a water environment via magneto-inductive signals in the ELF to VLF range not to exceed 4000 Hz.

8. A method according to claim 7 further comprising the steps of:

receiving said magneto-inductive signals in said one of a ground environment and a water environment via at least one relay module;

demodulating said representative signals from said magneto-inductive signals to form demodulated signals; and broadcasting through the air RF signals representative of said demodulated signals.

9. A method according to claim 8 further comprising the step of:

receiving said RF signals at a remote monitoring station.

10. A method according to claim 9 further comprising the steps of:

arranging a plurality of said sensor modules to define a perimeter, said sensor modules having overlapping sensitivities with adjacent ones of said plurality of sensor modules along said perimeter; and receiving signals representative of said seismic vibrations along said perimeter by said at least one relay module.

11. A method according to claim 7 wherein said at least one sensor module includes at least one of the group of sensors for sensing magnetic influences, acoustic waves, infrared emissions, and heat fluctuations.

12. An intrusion detector system comprising:

first means fully buried in one of a ground environment and a water environment for sensing vibrations caused by intruders and for generating intrusion signals representative of said vibrations;

second means fully buried in said one of a ground environment and a water environment and coupled to said first means for transmitting said intrusion signals through said one of a ground environment and a water environment via magneto-inductive signals in the ELF to VLF range not to exceed approximately 4000 Hz;

third means fully buried in said one of a around environment and a water environment for receiving said magnet-inductive signals and for demodulating said intrusion signals therefrom to form demodulated signals; and fourth means coupled to said demodulating means for broadcasting through the air RF signals representative of said demodulated signals.

13. The intrusion detector system according to claim 12 further comprising:

fifth means disposed a distance from said fourth means for receiving said RF signals.

14. The intrusion detector system according to claim 12 wherein said first means are arranged to define a perimeter around which said vibrations can be sensed.

15. The intrusion detector system according to claim 12 wherein said first means includes at least one of the group of sensors for sensing magnetic influences, acoustic waves, infrared emissions, and heat fluctuations.

* * * * *